United States Patent [19]

Karvinen

[11] Patent Number: 4,464,226

[45] Date of Patent: Aug. 7, 1984

[54] PAPER MACHINE PRESS WITH A WIDE PRESSING ZONE

[75] Inventor: Mikko Karvinen, Vihtavuori, Finland

[73] Assignee: Valmet OY, Finland

[21] Appl. No.: 378,019

[22] Filed: May 13, 1982

[30] Foreign Application Priority Data

May 20, 1981 [FI] Finland ..... 811557

[51] Int. Cl.[3] ..... D21F 3/06

[52] U.S. Cl. ..... 162/358; 68/3 SS; 100/121; 100/156

[58] Field of Search ..... 162/205, 358; 100/37, 100/121, 156; 68/3 SS

[56] References Cited

U.S. PATENT DOCUMENTS

| | | | |
|---|---|---|---|
| Re. 30,268 | 5/1980 | Justus | 162/358 X |
| 3,797,384 | 3/1974 | Hoff | 162/360 X |
| 3,853,698 | 12/1974 | Mohr | 162/358 |

FOREIGN PATENT DOCUMENTS

| | | | |
|---|---|---|---|
| 436120 | 11/1974 | U.S.S.R. | 162/358 |
| 457765 | 2/1975 | U.S.S.R. | 162/358 |
| 457766 | 2/1975 | U.S.S.R. | 162/358 |
| 472511 | 9/1975 | U.S.S.R. | 162/205 |

*Primary Examiner*—Richard V. Fisher
*Attorney, Agent, or Firm*—Steinberg & Raskin

[57] ABSTRACT

A dewatering press section for a paper or cardboard web includes a press roll having a wide pressing zone over which a belt is provided to run guided by guide rollers with the web being arranged to run in the pressing zone in compression between the press roll and the belt. At least one fabric runs in the pressing zone and acts on a respective face of the web. A pressure transmitting device has a surface which overlies the belt substantially in the pressing zone. According to the invention, ultrasonic field generators are provided in association with the pressure transmitting device surface for applying an ultrasonic field substantially in the pressing zone such that the friction between the surface of the pressure transmitting device and the belt is substantially reduced. The ultrasonic field generators can operate at a single frequency, at a plurality of discrete frequencies or may emit a continuous spectrum of frequencies and the intensity of the ultrasonic field is selected such that in addition to reducing the friction between the belt and the surface of the pressure transmitting device, the ultrasonic field will also substantially promote the removal of water from the web within the pressing zone as well as the transfer of water removed from the web into the press fabric or fabrics.

9 Claims, 5 Drawing Figures

PAPER MACHINE PRESS WITH A WIDE PRESSING ZONE

BACKGROUND OF THE INVENTION

The present invention relates generally to paper machines, and more particularly, to press sections in paper machines.

Dewatering press sections of paper machines are known having a wide pressing zone, such a press section including a press roll in conjunction with which a belt or the like is guided by guide rollers and in which press the paper or cardboard web is adapted to run in compression between the press roll and the belt. A compression fabric or fabrics act upon a respective face or faces of the web as it passes through the pressing zone. Moreover, a pressure transmitting device in the form of a unitary pressure surface or plurality of pressure shoes is provided within the loop of the belt acting in the pressing zone of the dewatering press.

In connection with the state of the art relating to the present invention, reference is made to U.S. Pat. No. 3,797,384 of Beloit Corporation of Beloit, Wis. and to U.S. Pat. No. 3,783,097, reissued as U.S. Pat. No. Re. 30,268, also of Beloit Corporation.

A press construction is disclosed in the above-identified Finnish patent application wherein water is pressed from the paper web through the use of flexible belts with a wide pressing zone being obtained by means of tensioning the belts. A drawback of this prior art "long-nip press" is that the mechanical strength of the compressing belts and their associated guide rollers imposes a limitation on the achievement of a sufficiently high pressure on the web.

A so-called long-nip press is disclosed in the above-mentioned U.S. Pat. No. 3,783,097 in which a plurality of pressure shoes are provided which press the belt against the web and press roll to achieve dewatering. However, a drawback of this structure is that the friction between the pressure shoes and the adjoining belt requires a considerable consumption of energy. Moreover, due to the friction between the belt and the pressure shoes, both the belt and shoes tend to become worn rather quickly.

SUMMARY OF THE INVENTION

Accordingly, it is an object of the present invention to provide a new and improved dewatering press section for a paper or cardboard web having a wide pressing zone.

Another object of the present invention is to eliminate the above-noted drawbacks inherent in prior art press sections having wide pressing zones, or at least substantially reduce the drawbacks, by a relatively simple arrangement.

Briefly, in accordance with the present invention, these and other objects are attained in a paper machine dewatering press section which includes a press roll having a wide pressing zone, a belt running over the pressing zone with the web adapted to run in the pressing zone in compression between the roll and the belt, at least one fabric running in the pressing zone acting on a respective face of the web, and pressure transmitting means having a surface overlying the belt substantially in the pressing zone. According to the invention, means are provided in association with the pressure transmitting means for applying an ultrasonic field in the pressing zone such that the friction between the surface of the pressure transmitting means and the belt is substantially reduced.

It will be understood that the term ultrasonic or ultrasound denotes a mechanical wave or disturbance which moves through a medium with a frequency which is greater than the upper limit which is audible to humans, i.e., greater than a value which is usually somewhat lower than 20 kHz. The range of ultrasonic frequencies is usually considered to be about 20 to $5\times10^5$ kHz.

In certain cases, the advantages of the invention are also obtained through the application of audible frequencies or audible frequencies in combination with ultrasonic frequencies.

Further, in accordance with the invention, either discrete frequencies or oscillations over a continuous spectrum may be utilized. In this connection, the use of discrete frequencies is most advantageous when a so-called resonance technique, described in detail below, is employed. In other cases, the frequencies of the oscillation field vary over a wide spectrum similar to so-called white noise.

Application of the invention has unexpectedly been found to produce a synergistic effect in that the utilization of ultrasound will result not only in a significant reduction of the friction between the pressure transmitting means and the belt, but also at the same time will promote dewatering of the web within the wide nip or pressing zone.

The advantageous effects produced through the application of an ultrasonic field in the wide pressing zone appear to be based on the reduction of the internal friction in the liquid present between the surface of the pressure transmitting means and the belt and, with respect to the intensification of the dewatering from the web. This effect appears to be based on a reduction in the friction between the fibre mesh of the web and the water contained therein.

DESCRIPTION OF THE DRAWINGS

A more complete understanding of the present invention and many of the attendant advantages thereof will be readily appreciated as the same becomes better understood by the reference to the following detailed description when considered in connection with the accompanying drawings in which.

DESCRIPTION OF THE PREFERRED EMBODIMENTS

Figure 1:
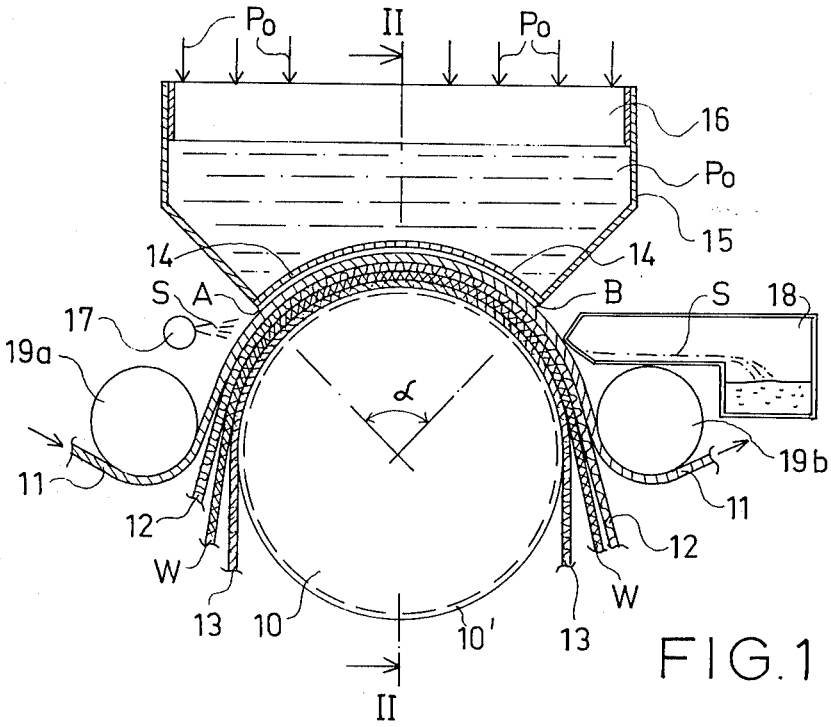
FIG. 1 is side elevational view in section of a wide pressing zone dewatering press section in accordance with the present invention.
Figure 2:
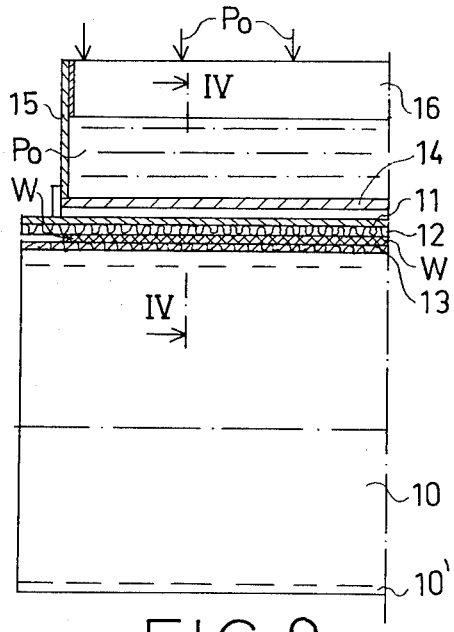
FIG. 2 is a sectional view taken along line II—II of FIG. 1.

Referring now to the drawings wherein like reference characters designate identical or corresponding parts throughout the several views, the press comprises a press roll 10, preferably having a recessed surface designated 10'. Situated over the roll 10 is a plate 14 having the configuration of a cylindrical segment and which forms part of a pressure transmitting means, described in detail below. The cylindrical segment plate 14 extends over a sector $\alpha$ of the roll 10 which constitutes the pressing or nip zone of the press.

The paper or cardboard web W from which water is removed within the pressing zone $\alpha$ passes between a pair of felts 12 and 13 into which the water removed from the web W is transferred. The felts 12 and 13 are guided in the form of loops in a conventional manner and are treated by typical felt reconditioning devices (not shown). A high-tension steel belt 11 or the like is guided by guide rollers 19*a* and 19*b* through the pressing zone $\alpha$. The belt 11 acts on the web W to exert a part of the pressure within the pressing zone $\alpha$. Moreover, the belt 11 will transmit the pressure applied by the pressure plate 14 of the pressure transmitting means to the felts 12 and 13 as well as to the web W situated between the felts.

A pressurized volume is defined over the pressure plate 14 by means of walls 15 extending upwardly from the margins of pressure plate 14. An appropriate hydraulic or pneumatic fluid is provided within the pressure volume which is maintained at an appropriate pressure $P_0$ by means of a piston 16 situated within the pressure volume. The pressure $P_0$ of the pneumatic or hydraulic fluid is transmitted to the pressure plate 14 and from the pressure plate 14 onto the belt 11 in the region of the pressing zone $\alpha$. It is understood that the piston 16 is mounted in the cylinder-like pressure volume with a sliding fit so that the pressure exerted can be selectively adjusted.

A liquid supply means 17 is situated at the beginning or inlet side in the machine direction of the pressing zone $\alpha$ for supplying liquid, e.g., water, onto the belt 11 so that the liquid is carried between the belt 11 and the pressure plate 14. The liquid, designated S, is collected at the outlet or end of the pressing zone $\alpha$ in the machine direction by means of a trough-like device 18.

As noted above, conventional press sections having the wide nip construction described above have suffered from the drawback that the relatively high friction between the pressure plate and adjoining belt has necessitated a correspondingly high consumption of energy. In accordance with the present invention, the friction between the pressure plate 14 and the belt 11 is substantially reduced through the application of an ultrasonic field in the pressing zone $\alpha$. In the illustrated embodiment, the means by which the ultrasonic field is so provided is constituted by a plurality of ultrasonic generators 20 which are fitted within corresponding recesses formed in the lower surface of the pressure plate 14. The ultrasonic generators 20 are preferably situated over substantially the entire area of the pressing zone $\alpha$ both in the direction of running of the web W as well as in the transverse direction. Thus, the generators 20 may be disposed in several rows in the machine direction, one row being illustrated in FIG. 4 wherein the generators 20*a*, 20*b*, 20*c*, etc. are situated one after the other in side-by-side fashion. The next row of detectors in the transverse direction may be displaced in stepwise fashion from the row illustrated in FIG. 4 so that the ultrasonic field applied by the ultrasonic generators 20 is as uniform as possible over the entire area of the pressing zone $\alpha$.

Figure 4:
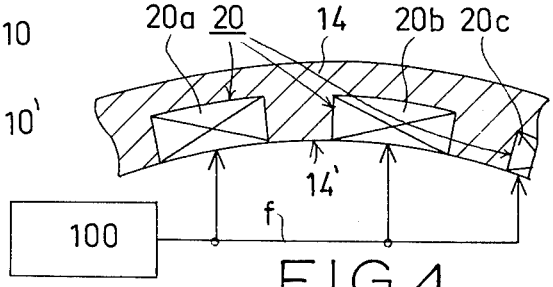
FIG. 4 is a sectional view taken along line IV—IV of FIG. 2 and illustrating ultrasonic generators for use in the present invention.

The ultrasonic generators 20 are driven at an appropriate ultrasonic frequency, designated f, by means of an ultrasonic drive 100, schematically illustrated in FIG. 4.

The ultrasonic generators 20 used in connection with the present invention are commercially available devices and can comprise, for example, piezoelectric ultrasonic generators. As noted above, the generators are fitted within grooves or recesses formed in the concave face of the pressure plate 14. The outer face of each generator 20 is appropriately machined so as to correspond to and form an extension of the smooth concave surface 14' of the pressure plate 14.

The liquid S supplied by the liquid supply means 17 functions both as a medium extending between the concave surface of the pressure plate 14 and the belt 11 and through which the ultrasonic field will travel as well as a lubricating medium between the concave face 14' and the upper face of the belt 11.

Through the application of an ultrasonic field of sufficient intensity in the manner described above, a considerable reduction in the friction between the face 14' of the pressure plate 14 and the upper face of the belt 11 is obtained. Moreover, the use of an ultrasonic field will promote the removal of water from the web W by dislodging the water from the fibre mesh of the web W.

As noted above, the favorable effect produced through the application of the ultrasonic field is partly a result of the reduction in the internal friction of the liquid media. However, the ultrasonic oscillations can be advantageously applied within the pressing zone $\alpha$ by means of the so-called resonance technique. In this connection, the outer or radiation faces of the ultrasonic detectors 20 which in the illustrated embodiment comprises the surface 14' of pressure plate 14, are spaced from the outer face of the belt 11 and/or the face of the press roll 10 so that the latter faces function so as to reflect the radiation back towards the generators. More particularly, the outer radiation faces of the ultrasonic generators are spaced at a distance L from the outer face of the belt 11 and/or the face of the press roll 10 such that $L=n\times\lambda/2$, wherein $\lambda=c/f$, and wherein c=the velocity of the ultrasonic waves and f=the frequency of the ultrasonic waves. By providing that the frequency f is selectively adjustable, it is possible to use the outer surfaces of the belt 11 and/or the face of the press roll 10 as a reflector. By means of the resonance technique as described above, in addition to reducing the friction between the outer surface 14' of the pressure plate 14 and the outer surface of the belt 11, a highly efficient ultrasonic field which will promote dewatering from the web can be produced between the inner face of the belt 11 and the face of the roller 10, where necessary. Such an ultrasonic field will mainly act by way of the reduction in the internal friction of the water removed from the web W and in the friction between the water and the fibres of the web.

Figure 3:
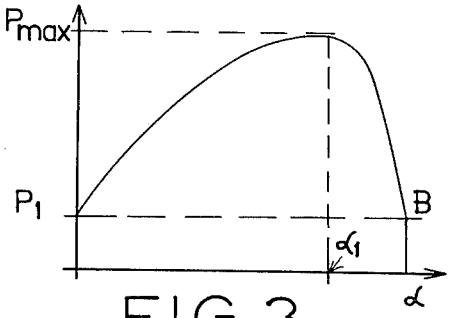
FIG. 3 is a graphical depiction illustrating the distribution of the pressure present in the pressing zone of the press section in accordance with the invention.

Referring to FIG. 3, a graph is illustrated therein depicting the variation of the pressure P from the beginning to the end of the pressing zone $\alpha$ in the machine direction.

A base pressure $P_1$ is present within the pressing zone due to the pressure produced by the tensioning of the belt 11. As seen in FIG. 3, the pressure within the pressing zone $\alpha$ increases from the beginning of the pressing zone corresponding to the point A in FIG. 1 to a maximum pressure $P_{max}$ at a point $\alpha_1$ which is in the region of the end of the pressing zone $\alpha$, designated by point B in FIGS. 1 and 3. The pressure distribution illustrated in FIG. 3 can be accomplished by appropriately shaping the pressure plate 14 and/or by dividing the pressure volume defined by the walls 15 into several compartments situated one next to the other in the direction of running of the web W, each compartment containing a hydraulic or pneumatic fluid at a different pressure. It has been found that a pressure distribution within the pressing zone $\alpha$ similar to that designated in FIG. 3 is especially favorable in connection with dewatering the web.

The maximum pressure $P_{max}$ is preferably on the order of about 1 to 10 MP, and preferably in the range of about 3 to 5 MP. The magnitude of the base pressure $P_1$ can be selectively obtained through suitably tensioning the belt 11 and of course is limited by the tension forces which can be tolerated by the belt 11 and its guide rollers.

In accordance with the invention, favorable results can be obtained with the ultrasonic generators 20 adapted to apply either discrete ultrasonic frequencies or ultrasonic oscillations having frequencies ranging over a continuous spectrum. Through suitable adjustment of discrete frequencies and a selection of the power density, it is possible to optimize the ultrasonic field for either reduction in the friction between the surface 14' of pressure plate 14 and belt 11, for producing an intensification of the dewatering of web W, or for both simultaneously.

Regarding the power density of the ultrasonic field, in most cases an appropriate power density is in the range of about 0.1 to 10 W/cm$^2$.

Figure 5:
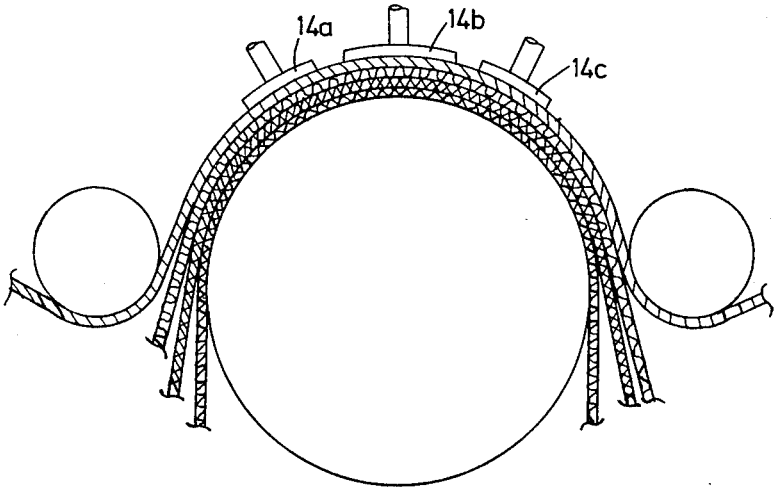
FIG. 5 is a view similar to FIG. 1 and illustrating another embodiment of a press section according to the present invention utilizing a plurality of successive pressure shoes.

The invention has been described in connection with an embodiment utilizing a unitary pressure plate 14. It is understood, however, that several successively situated pressure shoes may be substituted for the pressure plate 14 with suitable provisions being made for ultrasonic field applying means for reducing the friction between the pressure surface and belt 11 and/or for intensifying the removal of water from the web W. An embodiment wherein three successively situated pressure shoes **14*a*–14*c* are substituted for the pressure plate 14 is illustrated in FIG. 5**. Thus, any pressure transmitting means having a surface for applying a pressure in the manner described above may be utilized in connection with the present invention. Moreover, the means for applying the ultrasonic field in the pressing zone may take any suitable form and is not necessarily limited to the construction disclosed herein.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a paper machine dewatering press section for a paper or cardboard web, including a press roll having a wide pressing zone, a belt running in the pressing zone with the web adapted to run in the pressing zone in compression between said roll and said belt, at least one fabric running in the pressing zone acting on a respective face of the web, and pressure transmitting means having a surface overlying said belt substantially in the pressing zone, the improvement comprising:

said pressure transmitting means including a pressure plate having a substantially cylindrical segment configuration, said surface of said pressure transmitting means being constituted by the concave surface of said cylindrical segment plate; and means provided in association with said pressure transmitting means for applying an ultrasonic field substantially in the pressing zone such that the friction between the concave surface of said cylindrical segment plate and said belt is substantially reduced.

2. The combination of claim 1 wherein said ultrasonic field applying means also applies an audio-frequency oscillation field substantially over the pressing zone.

3. The combination of claim 1 further including means situated at the beginning of the pressing zone in the machine direction for supplying a liquid between the belt and said pressure transmitting means surface and means situated at the end of the pressing zone in the machine direction for collecting the liquid.

4. The combination of claim 1 wherein said at least one fabric comprises a pair of fabrics between which the web is adapted to be situated as it passes in the pressing zone.

5. The combination of claim 1 wherein said pressure transmitting means includes means for transmitting a progressively increasing pressure which increases progressively from the beginning towards the end of the pressing zone in the machine direction so that the maximum pressure occurs in the region of the end of the pressing zone.

6. The combination of claim 1 further including means for tensioning said belt in the region over the pressing zone so that the pressure in the pressing zone and immediately prior and subsequent thereto is in part produced by a tensioning force exerted by said belt.

7. In a paper machine dewatering press section for a paper or cardboard web, including a press roll having a wide pressing zone, a belt running in the pressing zone with the web adapted to run in the pressing zone in compression between said roll and said belt, at least one fabric running in the pressing zone acting on a respective face of the web, and pressure transmitting means having a surface overlying said belt substantially in the pressing zone, the improvement comprising:

said pressure transmitting means including a pressure plate having a substantially cylindrical segment configuration, the concave surface of said pressure plate being in opposed relationship to said roll forming said pressing zone; and means provided in association with said pressure transmitting means for applying an ultrasonic field substantially in the pressing zone such that the friction between the surface of said pressure transmitting means and said belt is substantially reduced, said ultrasonic field applying means comprising ultrasonic generators mounted in said pressure plate.

8. The combination of claim 7 wherein said pressure plate constitutes a part of a pressure chamber adapted to contain a fluid, and further including piston means situated in said pressure chamber for producing a pressure in said fluid contained in said pressure chamber, said pressurized fluid producing a compression within the pressing zone.

9. The combination of claim 7 wherein said ultrasonic generators are fitted within recesses formed in said cylindrical segment pressure plate of said pressure transmitting means, and wherein each of said ultrasonic generators includes an outer face which is shaped so as to conform to and form an extension of the concave surface of said cylindrical segment plate.

* * * * *